US005955196A

United States Patent [19]

Sakellerides

[11] Patent Number: 5,955,196

[45] Date of Patent: Sep. 21, 1999

[54] POLYESTER FIBERS CONTAINING NAPHTHALATE UNITS

[75] Inventor: Stefanos Sakellerides, Naperville, Ill.

[73] Assignee: BP Amoco Corporation, Chicago, Ill.

[21] Appl. No.: 08/852,251

[22] Filed: May 16, 1997

Related U.S. Application Data

[63] Continuation-in-part of application No. 08/673,308, Jun. 28, 1996, abandoned.

[51] Int. Cl.[6] ..... B32B 27/34; D04H 1/58; C08G 63/02

[52] U.S. Cl. ..... 428/395; 428/364; 442/199; 442/361; 528/298

[58] Field of Search ..... 428/364, 395; 528/298, 199; 442/361

[56] References Cited

U.S. PATENT DOCUMENTS

| | | |
|---|---|---|
| 4,000,239 | 12/1976 | Hamana et al. . |
| 4,001,479 | 1/1977 | Hamana et al. . |
| 5,466,525 | 11/1995 | Maria et al. . |
| 5,637,398 | 6/1997 | Araki et al. . |
| 5,663,238 | 9/1997 | Wang et al. . |
| 5,705,600 | 1/1998 | Jones et al. . |

FOREIGN PATENT DOCUMENTS

| | | |
|---|---|---|
| 4341582 | 11/1992 | Japan . |
| 8113826 | 5/1996 | Japan . |

OTHER PUBLICATIONS

"PET Modified with Purified Isophthalic Acid for Shrink Fiber Applications"—Amoco Chemical Company GTSR–113, May, 1994.

PET Modified with Purified Isophthalic Acid for Shrink Fiber Applications: Random Copolymers and Blends—Amoco Chemical Company GTSR–113, Nov. 1995.

PCT Chemical Abstract, Abstract No. 117276K, May 1996.

PCT Patent Abstract of Japan, 61266613, Nov. 1996.

PCT Database WPI, AN 88–012365, Nov. 1987.

PCT Database WPI, AN 94–230820, Jun. 1994.

PCT Patent Abstract of Japan, 62057917, Mar. 1987.

*Polymer,* Vo. 36, No. 3 pp. 451–459, 1995, X. Lu and A. H. Windle, Authors, "Crystallization of random copolymers of Poly(ethylene terephthalate) and poly(ethylene naphthalene–2,6–dicarboxylate".

*Primary Examiner*—William Krynski
*Assistant Examiner*—J. M. Gray
*Attorney, Agent, or Firm*—Thomas E. Nemo; Scott P. McDonald; Wallace L. Oliver

[57] ABSTRACT

An extruded polyester fiber comprising aromatic ester units of at least terephthalate and 2,6-naphthalate where the 2,6-naphthalate units comprise about 10 mole percent to about 90 mole percent of the total aromatic ester units in the polyester.

30 Claims, 2 Drawing Sheets

POLYESTER FIBERS CONTAINING NAPHTHALATE UNITS

This application is a continuation-in-part application of U.S. patent application Ser. No. 08/673,308, filed on Jun. 28, 1996 now abandoned.

FIELD OF THE INVENTION

This invention relates to new polyester fibers. More particularly, this invention relates to new polyester fibers wherein the polyester component of the fiber is a polyester having terephthalate and 2,6-naphthalate units, and wherein the mole percent of 2,6-naphthalate units in the polyester compared to the total amount of aromatic ester units is about 10 to about 90. This invention also relates to articles of manufacture prepared using such new polyester fibers.

BACKGROUND OF THE INVENTION

Polyesters are now widely used in the manufacture of fibers for textiles and other applications. One such polyester, polyethylene terephthalate (PET), is produced world-wide in billions of pounds per year. PET is typically made by the condensation of terephthalic acid (TA) or dimethylterephthalate (DMT) with ethylene glycol. While PET has many desirable properties that make it suitable for manufacturing fibers, there is a continuing need for new polyester fibers that have improved properties, or properties that are different from PET, thereby opening new uses for polyester fibers. Since PET is manufactured worldwide in such large amounts for application in textiles as well as in, for example, packaging for liquids, there is also a need to find uses for recycled PET.

Although 2,6-naphthalenedicarboxylic acid (NDA) and its dimethyl ester, dimethyl-2,6-naphthalenedicarboxylate (NDC), have been known for many years, there has been great commercial interest recently in polyesters made from NDA or NDC. For example, polyethylenenaphthalate (PEN) prepared by condensing NDA or NDC with ethylene glycol is a high performance polyester that is useful in film and fiber applications. As film, it has superior gas barrier properties and as a fiber it has superior tenacity. NDC is now commercially available from Amoco Chemical Company, and it is currently being used in the commercial manufacture of bottles and films. Thus, in addition to recycling PET, there is also a need to find uses for recycled PEN or other polyesters containing the 2,6-naphthalate unit.

The present invention, which is a polyester fiber having both terephthalate and 2,6-naphthalate units, is an improved fiber in that it has high shrink properties which makes it useful in fiber applications where crimp retention or high bulk is desired, such as in carpet yarns, "hi-loft" non-woven fabrics used as interlinings, cushioning and filtration media, as well as in specialty yarns for weaving and knitting. The fibers of this invention also have a lower melting temperature compared to PET which makes them useful as binder fibers in non-wovens, particularly in combination with PET homopolymer fibers. Since the polyester fibers of this invention can be prepared from blends of polymers, for example, a blend of PET with PEN, or a blend of PET with a copolymer having terephthalate and naphthalate units, the fibers of this invention can be made from recycled PET and PEN, or by blending recycled PET with copolyester containing terephthalate and 2,6-naphthalate units, thus providing a valuable use for recycled polyester materials.

Fibers made from PET modified with isophthalate units have been described in Amoco Chemical Company Bulletin GTSR-113A, November 1995, "PET Modified with Purified Isophthalic Acid for Shrink Fiber Applications." Relative to such isophthalic acid modified PET, the fibers of the present invention have a higher glass transition temperature (Tg) making them more suitable for certain fiber applications such as filters for filtration of hot gases. Additionally, the incorporation of naphthalate units in PET provides for a polyester with improved thermal, oxidative and hydrolytic stability.

SUMMARY OF THE INVENTION

This invention is a polyester fiber, preferably an extruded fiber, comprising aromatic ester units of at least terephthalate and 2,6-naphthalate, and where the 2,6-naphthalate units comprise about 10 mole percent to about 90 mole percent of the total aromatic ester units in the polyester. The fibers of this invention can be in the form of a single filament or a multi-filament fiber. This invention is also articles of manufacture containing such fibers such as yarn, thread, carpet yarn, woven fabrics and non-woven fabrics. As used herein, terephthalate unit means that ester unit or part of the polyester which is based on or derived from terephthalic acid or its equivalent, and 2,6-naphthalate unit means that ester unit or part of the polyester which is based on or derived from 2,6-naphthalenedicarboxylic acid or its equivalent. The equivalent of terephthalic acid or 2,6-naphthalenedicarboxylic acid can be, if example, the dimethyl ester or the diacid halide.

This invention is a polyester fiber comprising aromatic ester units of at least terephthalate and 2,6-naphthalate, and preferably where the 2,6-naphthalate units comprise about 10 mole percent to about 90 mole percent of the total aromatic ester units in the polyester, and wherein the fiber has been heat shrunk. These heat shrunk fibers can be in the form of a single filament or a multi-filament fiber. This invention is also articles of manufacture containing such fibers such as yarns, threads, carpet yarns and non-woven fabrics.

DESCRIPTION OF THE PREFERRED EMBODIMENTS

Figure 1:
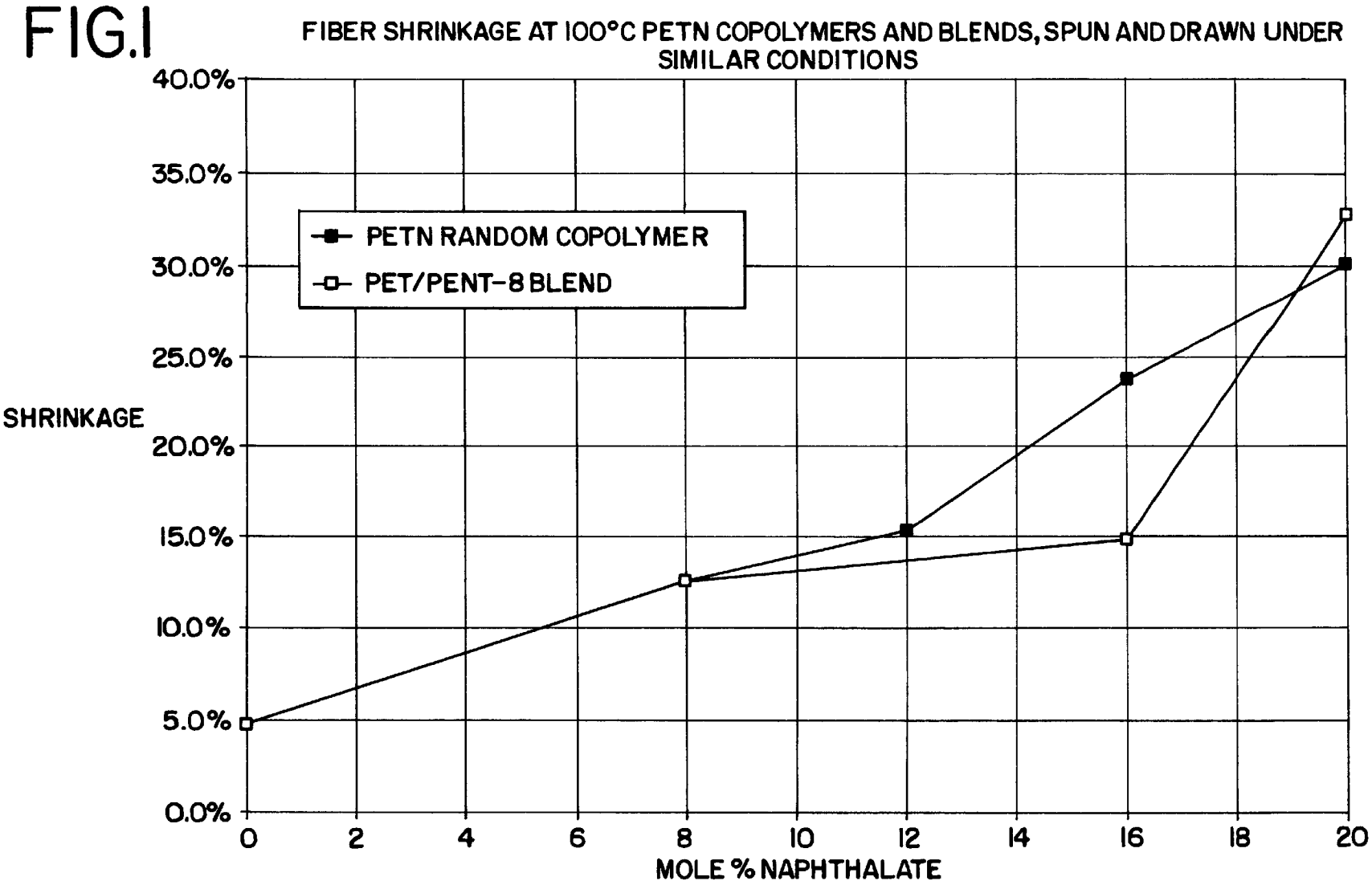
FIG. 1 is a graph showing the shrinkage properties of some of the fibers of this invention.

The polyester used for making the fibers of this invention comprises aromatic acid ester units which are at least terephthalate and 2,6-naphthalate units. Preferably, the polyester consists essentially of terephthalate and 2,6-naphthalate units. The amount of 2,6-naphthalate units in the polyester is about 10 up to less than about 92 mole percent, preferably about 12 to about 50 mole percent, more preferably about 12 to about 30 mole percent, and most preferably about 15 to about 25 mole percent of the total aromatic ester units in the polyester.

The polyesters used for making the fibers of this invention may contain other ester units in addition to 2,6-naphthalate and terephthalate units. For example, they may contain isophthalate ester units, or ester units derived from aliphatic dicarboxylic acids having, for example, 2 to 6 carbon atoms such as adipic or succinic acid, or they may contain one or more ester units derived from other isomers of naphthalene dicarboxylic acids.

The polyester used for preparing the fibers of this invention can be prepared by methods known by those of skill in the art. For example, the polyester can be prepared by condensing terephthalic acid, or one or more of its equivalents such as DMT, with NDA or one or more of its equivalents such as NDC, in the presence of a glycol such as ethylene glycol. When the esters such as DMT or NDC are used, the condensation reaction with the glycol produces an alcohol by-product which must be removed from the polymerization reaction. When the aromatic acids are used, the condensation with the glycol produces water, which must also be removed from the condensation reaction mixture. In general, when the polyesters of this invention are prepared by reacting the acids or esters with a glycol, the condensation reaction is conducted in two stages. The first stage is the transesterification stage or, if the acid is used, the esterification stage, where the ester or acid is first reacted with a molar excess of glycol. The mole ratio of glycol to aromatic acid or ester is suitably about 1.05:1 to about 2:1. In this stage, it is generally useful to use a transesterification (or esterification) catalyst such as calcium acetate, manganese acetate or cobalt acetate. Other catalysts known to those of skill in the art can be used. During the transesterification (or esterification) with a glycol, the stoichiometric amounts of alcohol or water are removed from the reaction mixture while the reaction mixture is heated. The next stage is the polycondensation stage. In the polycondensation stage the reaction mixture is heated, generally in the presence of a polycondensation catalyst such as antimony trioxide or other catalysts known to those of skill in the art, and the excess glycol is removed typically using a vacuum to assist with the removal of the glycol. During the polycondensation stage, the polymer appreciates in molecular weight . The increase in molecular weight can be monitored by inherent viscosity (IV) measurements. A preferred IV is about 0.4 to about 1.5 dl/g. Upon attaining a desired IV, the polymer can be removed from the reaction vessel, typically in the form of an extruded strand which is first cooled then cut into pellets for further use. In preparing the polyesters by this polycondensation method, the aromatic carboxylic acids such as NDA and TA or the esters, i.e., NDC and DMT, are charged to the polymerization reaction mixture in the molar ratios that are desired for the resulting polyester. The preparation of the polyester can be by a batch or continuous process.

The glycol used for the condensation reaction can be any glycol, preferably it has 2 to 8 carbon atoms, preferably it is ethylene glycol or butylene glycol, and most preferably it is ethylene glycol. Mixtures of glycols can also be used. Polyesters prepared by reacting aromatic carboxylic acids or their esters with a glycol are referred to as copolymers or copolyesters. 1,4-cyclohexanedimethanol is also a glycol that can be used.

The polyester useful for preparing the fibers of this invention can also be made by blending polyester materials to achieve the desired mole ratio of terephthalate and 2,6-naphthalate units. Thus, PET can be blended with PEN to achieve a polyester having the desired molar ratios. Also, PET containing a certain amount of naphthalate, for example a PET that contains 8 molar percent of 2,6-naphthalate (PETN-8) can be blended with PEN, or with a PET containing 10 or 20 mole percent 2,6-naphthalate (i.e., PETN-10 or PETN-20), to achieve a desired ratio of terephthalate to 2,6-naphthalate units. The blend can be made by simply making a physical mixture of the polyesters, preferably where the polyesters are of a size (i.e., a pellet or chip) that provides for intimate and uniform mixing of the polyesters, followed by melting the mixture. The polyester used for the blends can contain ester units in addition to terephthalate and 2,6-naphthalate, such as isophthalate, adipate, succinate and the like.

The fibers of this invention can be made by extruding the molten polyester, prepared from a polycondensation reaction or from a blend of polyesters, using extruding procedures known by those of skill in the art. Extruded fiber means a fiber that has been made by forcing a molten polyester through a die followed by quenching in for example, a cool gas or liquid, to solidify the fiber. In a second step in preparing the fiber, the extruded fiber can be drawn or stretched to achieve preferred orientation of the polyester. Preferably, the stretch ratio of the fiber is about 2:1 to about 4.5:1. Typically, the fiber is drawn at a temperature which is greater than the glass transition temperature (Tg) but less than the melt temperature (Tm). When drawn at temperatures of at least about 140° C., the resulting fiber exhibits high shrinkage at high temperatures, but relatively low shrinkage, for example, shrinkage approximately equivalent to the shrinkage of PET, at low temperatures.

The fibers of this invention can, for example, be made using spinning equipment available from Hills, Inc., W. Melbourne, Fla., U.S.A. The fiber can be in the form of a single filament, or it can be in the form of a multi-filament fiber, in continuous or staple form, or in the form of a spun bonded or melt blown web. The individual single filament extruded fiber can have a thickness of about 0.1 to about 20 denier, more preferably about 1 to about 10 denier. It is most desirable for the fiber to have a uniform diameter along the entire length of the fiber. The inherent viscosity of the fibers, measured at 30° C. in a 0.4 gram/100 gram solution of 60:40 phenol/tetrachloroethane is suitably about 0.4 to about 1.5 dl/g. The glass transition temperature (Tg) of the fibers as measured by DSC on heat after quench is suitably greater than 80° C. and preferably about 84° C. to about 120° C. The fibers of this invention prior to being shrunk preferably have a tenacity of at least about 2.5, more preferably of at least about 3.0, and preferably they have an Elongation at Break of at least about 10%, more preferably at least about 15%. After shrinkage, the tenacity of the fiber is typically reduced. For the shrunk fiber the tenacity is preferably at least about 0.25, more preferably at least about 0.30. Tenacity and Elongation at Break values disclosed herein can be determined in accordance with the procedures reported in the Examples.

Fibers of this invention prepared from polyester containing both terephthalate and 2,6-naphthalate units exhibit desirable shrinkage when heated at elevated temperatures. Any effective temperature can be used to shrink the fiber; however, it is generally between the Tg and the Tm for the fiber. Fiber shrinkage is conveniently measured by heating a free fiber at 100° C. or at 177° C. (350° F.) for 2 minutes in air and comparing the length of the fiber before and after such heating. The fibers of this invention preferably shrink at least about 10%, more preferably at least about 15% and most preferably at least about 20% when the free (e.g. a suspended fiber) is heated at 100° C. in air for 2 minutes. For example, the fiber of this invention made from a PETN-20, i.e., the polyester made by condensing a mixture of 80 mole percent terephthalic acid (or DMT) with 20 mole percent NDA ( or NDC) with ethylene glycol, exhibited a shrinkage of 30 percent when heated at 100° C. for 2 minutes, whereas a PET fiber prepared in the same manner had only a 5 percent shrinkage. The shrinkage of the polyester fiber containing the naphthalate is advantageous for using the fiber in applications where crimp retention or high bulk is desired such as in carpet yarns; "hi-loft" non-woven fabrics used as interlinings, cushioning and filtration; or in specialty yarns for weaving or knitting. The shrunk fibers of this invention are preferably heat shrunk at least about 15%, more preferably at least about 20% compared to their length prior to heat shrinking; or, relative to a fiber of PET of the same mechanical properties such as tenacity or elongation, or that has been extruded and drawn under the same conditions, it is suitably a fiber that has been shrunk at least about 50%, preferably at least about 100%, more preferably at least about 200% and most preferably at least about 300% more than such PET fiber can be shrunk. The shrunk fibers of this invention are suitably shrunk at a temperature of at least 80° C., more preferably at a temperature of at least 100° C. The fibers can be shrunk before or after they are incorporated into an article of manufacture. The fibers of this invention also exhibit a relatively low melting point which makes them useful for applications where a low melting point is desirable, such as in thermally bonded non-wovens. However, even though the melting temperatures are lower than, for example, PET, the glass transition temperatures are higher than the glass transition temperatures of PET modified with similar levels of isophthalic acid which make the fibers of this invention useful in high temperature applications. The melting temperature (Tm) of the fibers of this invention, as mentioned above, are lower than the Tm of PET. The preferred Tm of the fibers of this invention is at least about 200° C., preferably at least about 220° C. and most preferably at least about 230° C. Tg and Tm for the fibers of this invention were determined in accordance with the procedures reported in the Examples. Surprisingly, the fibers of this invention made from blends of polyesters rather than by copolymerization, for example, blends made from recycled polyester, exhibit a higher Tm compared to the fiber having the same shrinkage but made by copolymerization. Therefore, in applications where a high shrink fiber having a high Tm is desired, the fibers of this invention made from blends are preferred.

The fibers of this invention, either shrunk or prior to shrinking, can be used to make staple, yarn, including, for example, yarn that is in spun, draw-texturized or bulk continuous filament form, knitted fabrics, woven fabrics, non-woven fabrics, and crimped fibers made in accordance with procedures known by those of skill in the polyester fiber art. Such procedures are described in the publication "Polyester-50 Years of Achievement," published by The Textile Institute, Manchester, England, printed in Dewsbury, England in 1993 by Stanley Press, and in "Wellington Sears Handbook of Industrial Textiles", by E. R. Kaswell, Wellington Sears Co., 1963, both of which publications are specifically incorporated by reference herein.

The above-described fabrics, yarns and other articles of manufacture are improved by the fibers of this invention because they exhibit the benefits of having heat shrinkable fibers and improved high temperature properties resulting from the higher Tg of the fibers.

As described hereinabove, the fibers of this invention can be made from recycled polyester. Recycled polyester includes polyester previously used for some other application, such as bottles or films. For example, the used bottle can be cut or ground (so-called, "recycled bottle flake") and used to prepare the fibers of this invention.

DETAILED DESCRIPTION OF THE FIGURES

FIG. 1 shows a plot of the % shrinkage of the fibers of this invention made from copolymers and from blends as a fraction of mole % naphthalate in the polyester fiber. As the plot shows, shrinkage increases rapidly at levels of naphthalate over 10 mole percent.

Figure 2:
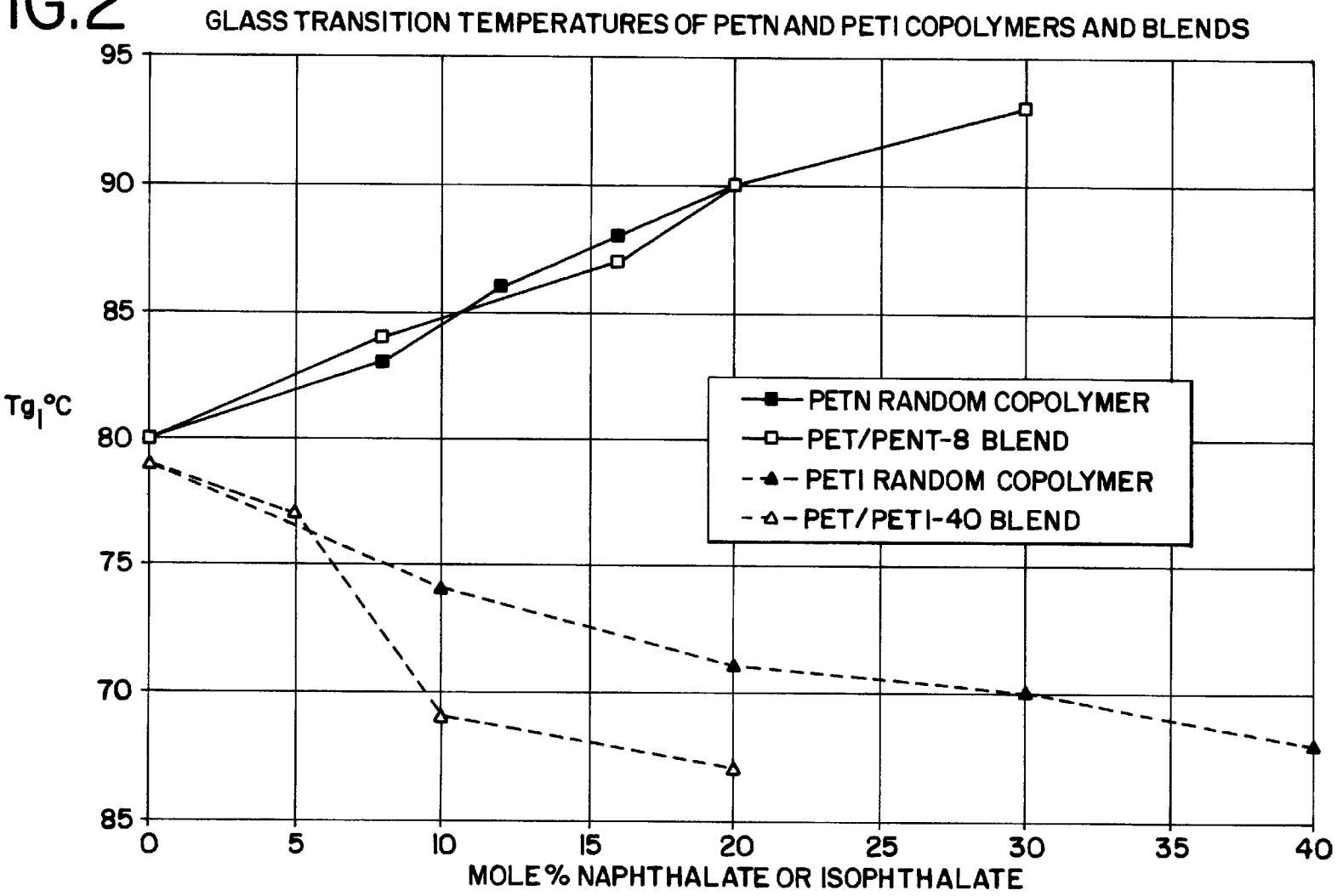
FIG. 2 is a graph showing the thermal properties of some of the fibers of this invention.

FIG. 2 shows a plot of glass transition temperature (Tg) of fibers prepared containing terephthalate and naphthalate ester units compared to fibers containing terephthalate and isophthalate ester units (PETI).

U.S. patent application Ser. No 08/673,308, filed on Jun. 28, 1996, is hereby specifically incorporated by reference in its entirety.

EXAMPLE OF THE INVENTION

Fiber Testing Procedures. Tensile Properties—Prior to testing, the fiber samples were conditioned for at least 24 hours in air at 23° C. and 50 percent relative humidity. The denier value indicates the weight in grams of 9000 meters and was measured according to ASTM D-1577 by weighing a sample length of 22.5 cm in a precision balance.

Tensile properties (tenacity, modulus, elongation at break) of the fibers were measured on an Instron Universal Testing Instrument, according to ASTM D-2256. The test conditions were crosshead speed 5.0 in/min; gauge length 4.0 in. Five replicates were tested, and the average is reported.

Thermal Properties—Thermal properties of the fibers were measured in a differential scanning calorimeter (DSC), model DuPont 2100. The melting temperature (Tm) was measured on the first heat scan (representing the actual melting behavior of the drawn fiber) conducted at a heating rate of 20° C./min. The glass transition temperature (Tg) was measured after quenching the sample rapidly following melting and then subjecting the resulting amorphous material to a second heating scan at a rate of 20° C./min. This was done because the glass transition on the first heating scan was difficult to distinguish, due to the crystallinity of the fiber.

Thermal Shrinkage—Thermal shrinkage of the fibers was tested by suspending 20 cm long fiber specimens under their own free weight, inside a forced circulation oven in air for 2 minutes at a temperature of 100° C. or at 177° C. (350° F.). Three samples were tested and the average shrinkage is reported. The number reported is the reduction in length as percentage of the initial length.

Crystallinity—Percent crystallinity of the fibers was determined from density measurements in a density gradient column. The values reported correspond to volume percent crystallinity calculated from the following equation:

$$\%\ \text{Crystallinity by Volume}=(\rho-\rho am)/(\rho_c-\rho am)$$

where ρc is the density of 100 percent crystalline material and ρam is the density of the 100 percent amorphous material. These values are 1.455 and 1.333 g/ml, respectively, for PET homopolymer and 1.407 and 1.325, respectively, for PEN homopolymer.—The values used for the naphthalate containing copolymers and blends were approximated by the following expressions:

$$\rho am=1.333(1-x)+1.325x$$

$$\rho c=1.455(1-x)+1.407x$$

where x is the mole fraction of equivalent PEN repeat units.

EXAMPLE 1

A polyethylene terephthalate (PET) copolymer modified with 20 mole percent naphthalate repeat units ("PETN-20") was prepared in a 56 liter, melt polymerization reactor as follows:

Ethylene glycol (16264 grams), dimethyl terephthalate (DMT, 25440 grams), and dimethyl-2,6-naphthalene dicarboxylate (NDC, 8000 grams) were charged to a 56 liter batch reactor. The reactor was fitted with a distillation column for separating methanol or water from ethylene glycol, a vacuum system, and an anchor helix agitator capable of handling high viscosity materials. Calcium acetate (4.38 grams), manganese acetate (6.81 grams), and cobalt acetate (2.79 grams) constituted the transesterification catalyst package and were washed into the reactor with 525 grams of ethylene glycol. The reactor was purged with nitrogen and heated to a final transesterification temperature of 267° C. over the next 410 minutes under agitation (52 RPM). Heatup was accomplished gradually with setpoint changes (from 160 to 285° C.) in increments of 12.5° C.

During these first 410 minutes, which constituted the transesterification stage, the reactor pressure was maintained at atmospheric by means of a control valve, while volatile by-products (primarily methanol and some of the excess ethylene glycol) were continuously removed and condensed. The temperature at the top of the column stayed at 65° C. (boiling point of methanol) during the first 360 minutes of the transesterification step and then increased gradually reaching 190° C. by the end of transesterification (410 min). This indicated that removal of the methanol of reaction was almost complete and an azeotrope had been reached. The total condensate collected at the end of the transesterification step was 11229 grams (107% of the theoretical methanol of reaction).

At 395 minutes from the beginning of the procedure, the polycondensation catalyst, antimony trioxide (8.35 grams) was charged into the reactor along with 175 grams of ethylene glycol. At 405 minutes, phosphoric acid (4.43 grams) was charged along with 225 grams of ethylene glycol. The purpose of the phosphoric acid was to deactivate the polycondensation catalyst; it also acts as a heat stabilizer for the final polymer. At 410 minutes from the beginning of the procedure, the second step, polycondensation, was started. During the polycondensation step, the reactor pressure was reduced slowly to below 1 mm Hg in small increments to prevent excessive foaming and sublimation. As melt viscosity increased, agitation speed was reduced at specified torque values to prevent a temperature overshoot. At 562 minutes, when the melt temperature had reached 289° C., the temperature setpoint of the heating oil was reduced to 268° C. to prevent overheating. Melt temperature was maintained at 289° C. for the remaining 97 minutes, while the melt viscosity increased until a point where it was clear that further appreciation of molecular weight was becoming too slow. This was evidenced by the fact that the torque had stopped increasing at constant agitation speed (20 RPM). At that point in time (659 minutes from the start), the pressure was reduced to 0.865 mm Hg. Agitation was stopped, the vacuum was interrupted, the temperature setpoint was increased to 285° C. and the polymer was discharged by a melt pump. The molten polymer exited the reactor through a six-hole die in the form of clear strands which were immediately quenched into amorphous solid form by guiding through an ice bath. Finally, the strands were fed through a pelletizer and cut into pellets. The total product collected was 23982 grams. The total condensate collected was 11227 grams during the transesterification step and 3407 grams during the vacuum polycondensation step.

The polymer inherent viscosity (IV) was determined in a 0.4 g/100 ml solution in 60:40 phenol/tetrachloroethane at 30° C. The measured value was 0.61 dl/g.

The above resin was spun and drawn into multi-filament fiber. Directly before spinning, the resin was dried for 16 hours in a desiccant drier at 120° C. and air dew point of −60° C.

The apparatus used for spinning, capable of on-line drawing and final speed of 6000 m/min, was obtained from Hills Inc. of W. Melbourne, Fla., USA. The main components of the unit were:

(a) a 1.25 in, 30 L/D extruder with nitrogen-purged hopper, which melts the polymer;

(b) a static mixer to even out temperature variations across the melt stream;

(c) a 5.5 cc/revolution gear pump for accurate metering of the melt to the spinpack;

(d) a spinpack with a 4-layer screen filter (going progressively from 20 mesh to 150 mesh) and a 80-hole spinneret (hole diameter 0.5 mm, hole length 0.75 mm);

(e) a quench chamber, supplying laminar air flow to solidify the filaments coming out of the spinneret;

(f) a spin finish applicator to lubricate the yarn and eliminate static; the spin finish used was a 20 percent by volume emulsion of Lurol TC-35 (Goulston Co., Monroe, N.C.) in water;

(g) a feed roll, which conveys the treadline from the spinneret to the drawing section;

(h) a pre-draw heated roll, which heats the yarn and provided partial drawing;

(i) two pairs of draw rolls, which complete the drawing process; and (j) a winder available from Barmag Inc., which collects the drawn yarn on paper tube packages.

The extruder temperature profile was as follows:

Zone 1: 290° C.

Zone 2: 290° C.

Zone 3: 290° C.

Zone 4: 290° C.

Spin Head: 295° C. (includes pump, motionless mixer, filters and spinneret)

The residence time in the extruder is estimated to be in the order of 1–2 minutes.

Air at 20° C. was used for quenching the filaments as they came down from the spinneret. The draw roll temperatures were as follows:

| | |
|---|---|
| Feed Roll | 120° C. |
| Pre-draw Roll | 120° C. |
| Draw Roll 1 | 100° C. |
| Draw Roll 2 | 110° C. |

A fiber sample was collected at a final speed of 3200 m/min and draw ratios of 3:1. The melt pump speed was adjusted so the final target denier stayed constant at 200 g/9000 m. The pump and godet speed profiles were as follows:

| Pump | RPM | 12.5 |
|---|---|---|
| Feed Roll | m/min | 1066 |
| Pre-draw Roll | m/min | 2335 |
| Draw Roll 1 | m/min | 3200 |
| Draw Roll 2 | m/min | 3200 |

The properties of the resulting multi-filament fiber were as follows:

| Total Denier | 192 |
|---|---|
| Denier per Filament | 192/80 = 2.4 dpf |
| Tenacity | 3.1 g/den |
| Initial Modulus | 88 g/den |
| Elongation at Break | 30% |
| Melting Temperature | 210° C. |
| Glass Transition Temperature | 90° C. |
| Thermal Shrinkage at 100° C. | 30% |

EXAMPLE 2

A pellet-to-pellet blend of PET, 0.61 IV, with PENT-8 copolymer, 0.54 IV, was prepared by weighting appropriate amounts of each resin resulting in a naphthalate content equal to 20% of the total repeat units. The blend was melt-spun and drawn in one step under conditions similar to those of Example 1. The resulting fiber properties were as follows:

| TENSILES | |
|---|---|
| Total Denier | 192 |
| Tenacity | 3.3 g/den |
| Initial Modulus | 79 g/den |
| Elongation at Break | 51% |
| DSC, First Heat at 20° C./min | Melting Temperature, 233° C. |
| DSC, Heat After Quench | Glass Transition Temperature, 90° C. |
| Crystallinity (by density) | 23% |
| Thermal Shrinkage at 100° C. | 33% |

COMPARATIVE EXAMPLE 1

A PET homopolymer, with 0.62 IV, was melt-spun and drawn in one step under conditions similar to those of Examples 1 and 2. The resulting fiber properties were as follows:

| TENSILES | |
|---|---|
| Total Denier | 100 |
| Tenacity | 3.0 g/den |
| Initial Modulus | 73 g/den |
| Elongation at Break | 69% |
| DSC, First Heat at 20° C./min | Melting Temperature, 251° C. |
| DSC, Heat After Quench | Glass Transition Temperature, 80° C. |
| Crystallinity (by density) | 27% |
| Thermal Shrinkage at 100° C. | 5% |

EXAMPLES 3–7

PETN copolymers containing 8, 12, 16 mole percent naphthalate were prepared and then spun and drawn under similar conditions as in Example 1. PET/PETN-8 blends with naphthalate content 8 and 16 mole percent were prepared and then spun and drawn under similar conditions as those in Example 2. Tenacity and shrinkage properties of the fibers are shown in the table below (which includes for completeness the data from Examples 1 and 2, and Comparative Example 1): The fibers made from copolymers are reported as copolyesters in the table, and the fibers made from blends are reported as blends in the table.

| Example | Composition[a] | IV[b] (dl/g) | Tm[c] (° C.) | Tg[d] (° C.) | Tenacity (g/den) | 100° C. Shrinkage | 177° C. Shrinkage |
|---|---|---|---|---|---|---|---|
| Compar. | PET | 0.62 | 251 | 80 | 3.0 | 5% | 17% |
| 3 | PETN-8 Copolyester | 0.61 | 234 | 84 | 3.2 | 13% | 29% |
| 4 | 8% N Blend | | 246 | 84 | 3.2 | 10% | 24% |
| 5 | PETN-12 Copolyester | 0.64 | 227 | 86 | 3.3 | 15% | 52% |
| 6 | PETN-16 Copolyester | 0.63 | 219 | 89 | 3.0 | 24% | 68% |
| 7 | 16% N Blend | | 240 | 87 | 3.1 | 15% | 46% |
| 1 | PETN-20 Copolyester | 0.61 | 210 | 90 | 3.1 | 30% | 88% |
| 2 | 20% N Blend | | 233 | 90 | 3.3 | 33% | 66% |

[a]Blend means a polyester made from a blend of polyesters to form the desired composition.
% N means mole percent 2,6-naphthalate in blend.
PETN-8, etc., means a terephthalate/naphthalate/ethylene glycol copolyester having 8 mole percent naphthalate.
[b]IV means inherent viscosity of the resin used to make the fiber.
[c]Tm means melt temperature of fiber on first heat.
[d]Tg means glass transition temperature of the fiber on heat after quench.

The increase in shrinkage with naphthalate content is plotted in FIG. 1.

These data show the excellent shrinkage properties of the fibers of this invention. These data also show that, for the same shrinkage, fibers made from blends have a higher Tm than fibers made from the copolymer or copolyester.

That which is claimed is:

1. An extruded polyester fiber comprising aromatic ester units of at least terephthalate and 2,6-naphthalate wherein the 2,6-naphthalate units comprise about 12 to about 50 mole percent of the total aromatic ester units in the polyester.

2. The extruded polyester fiber of claim 1 that has been drawn.

3. The extruded polyester fiber of claim 1 that has been heat shrunk.

4. The extruded polyester fiber of claim 1 made at least in part from recycled polyester.

5. The extruded polyester fiber of claim 1 comprising polyester prepared by copolymerization of 2,6-naphthalenedicarboxylic acid or a compound based on 2,6-naphthalenedicarboxylic acid which yields an ester unit in the polyester equivalent to that obtained from 2,6-naphthalenedicarboxylic acid and terephthalic acid or a compound based on terephthalic acid which yields an ester unit in the polyester equivalent to that obtained from terephthalic acid.

6. The extruded polyester fiber of claim 1 comprising polyester prepared by blending polyester materials.

7. The extruded polyester fiber of claim 1 wherein the 2,6-naphthalate units comprise about 12 to about 30 mole percent of the total aromatic ester units in the polyester.

8. The extruded polyester fiber of claim 1 wherein the 2,6-naphthalate units comprise about 15 to about 25 mole percent of the total aromatic ester units in the polyester.

9. Articles of manufacture comprising the fiber of claim 1.

10. The articles of manufacture of claim 9 selected from the group consisting of staple, yarn, non-woven fabrics and woven fabrics.

11. An extruded polyester fiber of claim 1 that has been mechanically crimped.

12. The extruded polyester fiber of claim 1 which shrinks at least about 10% at a temperature of 100° C.

13. The polyester fiber of claim 1 wherein the fiber is formed by blending polyester materials and in which the polyester fiber made from the blended polyester materials contains between 8 and 20 mole percent naphthalate.

14. A multi-filament polyester fiber wherein one or more of the filaments in the multi-filament fiber is a polyester fiber comprising aromatic ester units of at least terephthalate and 2,6-naphthalate wherein the 2,6-naphthalate units comprise about 12 to about 50 mole percent of the total aromatic ester units in the polyester.

15. The multi-filament fiber of claim 14 having at least about 5 filaments.

16. The multi-filament fiber of claim 14 having at least about 25 filaments.

17. A polyester fiber comprising aromatic ester units of at least terephthalate and 2,6-naphthalate wherein the polyester has a Tm of at least about 200° C. wherein the 2,6-naphthalate units comprise about 12 to about 50 mole percent of the total aromatic ester units in the polyester.

18. The fiber of claim 17 which shrinks at least about 25% at a temperature of 177° C. (350° F.).

19. A polyester fiber comprising aromatic ester units of at least terephthalate and 2,6-naphthalate where the 2,6-naphthalate units comprise about 10 mole percent to about 90 mole percent of the total aromatic ester units in the polyester, said fiber being made at least in part from recycled polyester.

20. The polyester fiber of claim 19 that has been drawn.

21. The polyester fiber of claim 19 that has been heat shrunk.

22. The polyester fiber of claim 19 comprising polyester prepared by copolymerization of 2,6-naphthalenedicarboxylic acid or a compound based on 2,6-naphthalenedicarboxylic acid which yields an ester unit in the polyester equivalent to that obtained from 2,6-naphthalenedicarboxylic acid and terephthalic acid or a compound based on terephthalic acid which yields an ester unit in the polyester equivalent to that obtained from terephthalic acid.

23. The polyester fiber of claim 19 comprising polyester prepared by blending polyester materials.

24. The polyester fiber of claim 19 wherein the 2,6-naphthalate units comprise about 12 to about 50 mole percent of the total aromatic ester units in the polyester.

25. The polyester fiber of claim 19 wherein the 2,6-naphthalate units comprise about 12 to about 30 mole percent of the total aromatic ester units in the polyester.

26. The polyester fiber of claim 19 wherein the 2,6-naphthalate units comprise about 15 to about 25 mole percent of the total aromatic ester units in the polyester.

27. Articles of manufacture comprising the polyester fibers of claim 19.

28. The articles of manufacture of claim 27 selected from the group consisting of staple, yarn, non-woven fabrics and woven fabrics.

29. A polyester fiber of claim 19 that has been mechanically crimped.

30. The polyester fiber of claim 19 which shrinks at least about 10% at a temperature of 100° C.

* * * * *